United States Patent [19]

Miller et al.

[11] 4,120,412

[45] Oct. 17, 1978

[54] TRACKSIDE DOOR CLOSING ARRANGEMENT FOR RAILWAY HOPPER CARS

[75] Inventors: Roy W. Miller, Highland; Ernest J. Nagy, Munster, both of Ind.

[73] Assignee: Pullman Incorporated, Chicago, Ill.

[21] Appl. No.: 823,884

[22] Filed: Aug. 12, 1977

[51] Int. Cl.[2] ..... B61D 7/30

[52] U.S. Cl. ..... 214/63

[58] Field of Search ..... 214/58, 63; 105/241 C

[56] References Cited

U.S. PATENT DOCUMENTS

| | | | |
|---|---|---|---|
| 1,266,630 | 5/1918 | Ross et al. | 214/63 |
| 3,836,023 | 9/1974 | Peterson et al. | 214/63 |
| 3,951,077 | 4/1976 | Miller | 214/63 X |

*Primary Examiner*—Robert G. Sheridan

*Attorney, Agent, or Firm*—Thomas G. Anderson

[57] ABSTRACT

A trackside door closing arrangement for closing the swinging doors of a railway hopper car includes a pair of pneumatic tires and wheels mounted on a pivot arm. The tires are interconnected for rotation in concert and during engagement with the doors, swing them inwardly to a closed position.

9 Claims, 7 Drawing Figures

TRACKSIDE DOOR CLOSING ARRANGEMENT FOR RAILWAY HOPPER CARS

This patent application is related to a copending U.S. patent application Ser. No. 832,127 filed Sept. 12, 1977.

BACKGROUND OF THE INVENTION

1. Field of the Invention

The present invention relates to railway hopper cars of the type which discharges materials through side discharge openings normally closed by means of outwardly swinging doors. More specifically the invention relates to a trackside clsoing mechanism positioned to close the swinging doors of a railway hopper car as the car travels along the track adjacent to the mechanism.

2. Description of the Prior Art

Some of the patents of the prior art exemplifying devices for actuating hopper car doors are U.S. Pat. Nos. 1,266,630, May 21, 1918; 2,909,294, October 20, 1959; 3,080,075, Mar. 5, 1963; 3,765,341, October 16, 1973 and 3,951,077, Apr. 20, 1976.

SUMMARY OF THE INVENTION

The railway hopper car utilized with the present invention includes a plurality of hoppers having a central elongated hopper and two end hoppers which are ideally suited for transporting elongated objects such as logs and also such products as wood chips, etc. The car includes lower side discharge openings and doors which are suitably locked by locking mechanisms more specifically described in the aforementioned patent application. The type of doors utilized are hingedly mounted on the side of the car and have portions extending laterally inwardly below the car for opening and closing hopper openings which are in communication with the upper interior hoppers of the car. In the present arrangement three elongated longitudinally aligned doors are provided on each side of the railway car. As the car arrives at its destination the load is dumped by gravity and the doors are moved to their open positions until the car passes its dumping site. Beyond this site there are provided trackside operating devices to which the present invention applies. Each of the trackside operating mechanisms or arrangements include a base which is suitably supported adjacent the sides of the track on a concrete slab. Each slab has rigidly secured thereto a base which includes an upwardly extending pedestal pivotally mounted so that the pedestal can swing or tilt inwardly and outwardly relative to the sides of the railway car. The base includes a laterally extending horizontal support angle which is rigidly connected to the pedestal by means of a diagonal strut. The base also pivotally supports a fluid extensible device in the form of a cylinder and piston arrangement which is also pivotally connected to the upper ends of the horizontal angle whereby the tilting action of the vertical pedestal is transmitted to the cylinder and piston device. In the present invention the extensible device is hydraulically operable in that it includes an internal piston connected to the piston rod. Fluid conduits are connected to opposite ends of the piston of one device and to the other extensible device on the other side of the car in the same manner. Thus, if the pedestal tilts in one direction in response to the tilting action of a railway hopper car the other base on the other side of the car follows and tilts in the same direction.

A horizontal arm is connected to the base by vertical pivot means and is provided at opposite ends with pneumatic tire and wheel arrangements of a type similarly utilized with vehicles. Thus the tires and hub assemblies of each unit are easily pivotal about vertical axes on opposite ends of the horizontal moving arm. Each of the wheel and tire assemblies is also provided with rotating hubs which in turn have mounted thereon pulleys that are interconnected by means of an endless belt so that rotation of one of the wheels provides rotation in concert with the other wheel.

A spring and adjusting arrangment is provided between the horizontal swinging arm and the vertical pedestal and base assembly. This adjustable mechanism includes a spring device which is adjustable to normally position the horizontal arm at an angle relative to the longitudinal movement of a traveling railway car. The spring device maintains this position but is free to make the necessary adjustment when one of the wheels of each of the mechanisms engages the open doors of a railway car. As one of the wheels of each of the mechanisms on opposite sides of the car engages the door initially, the other wheel of each of the assemblies is also imparted the rotation of the first wheel so that as the wheels engage the sides of the doors, the doors are propelled inwardly to the closed position.

DESCRIPTION OF THE PREFERRED EMBODIMENT

Figure 1:
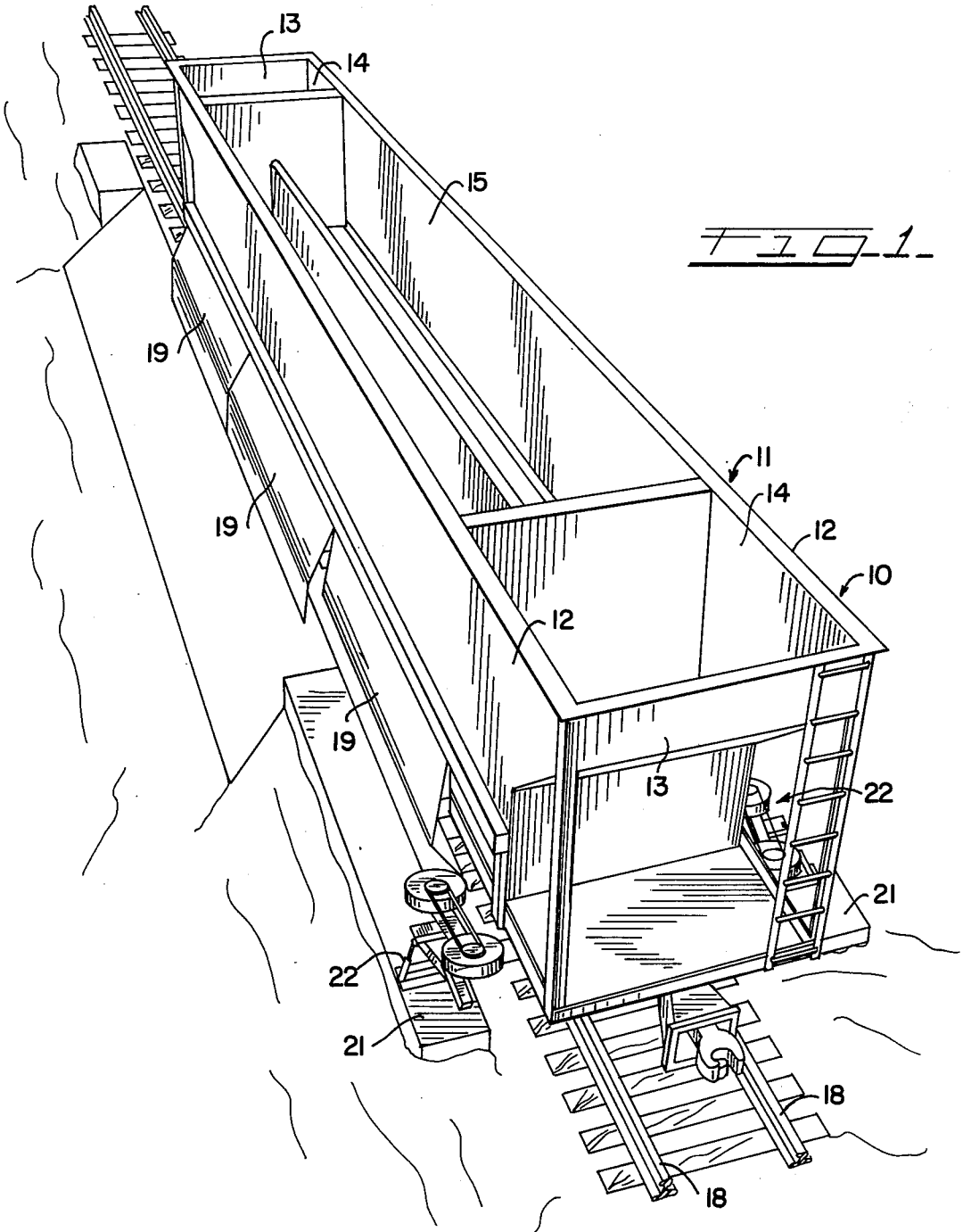
FIG. 1 is a perspective view of a railway hopper car mounted on a track and including trackside operating mechanisms for closing the doors of the car.

As best shown in FIG. 1 a railway hopper car 10 comprises a car body 11 including side walls 12 and end walls 13. The railway hopper car body 11 includes end hoppers 14 separated by a central enlarged hopper 15.

Figure 5:
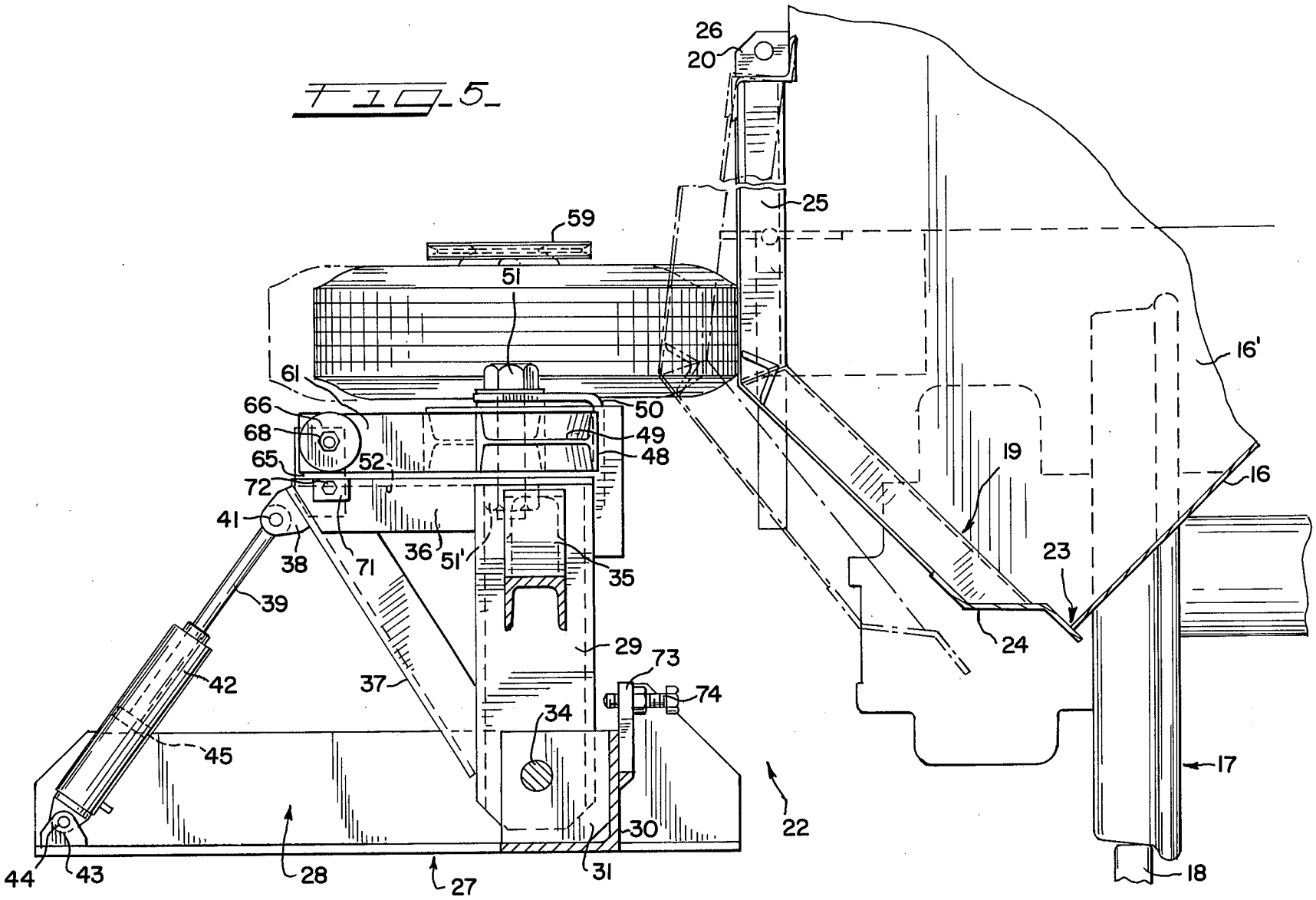
FIG. 5 is a cross-sectional view taken substantially along the line 5—5 of FIG. 4.
Figure 6:
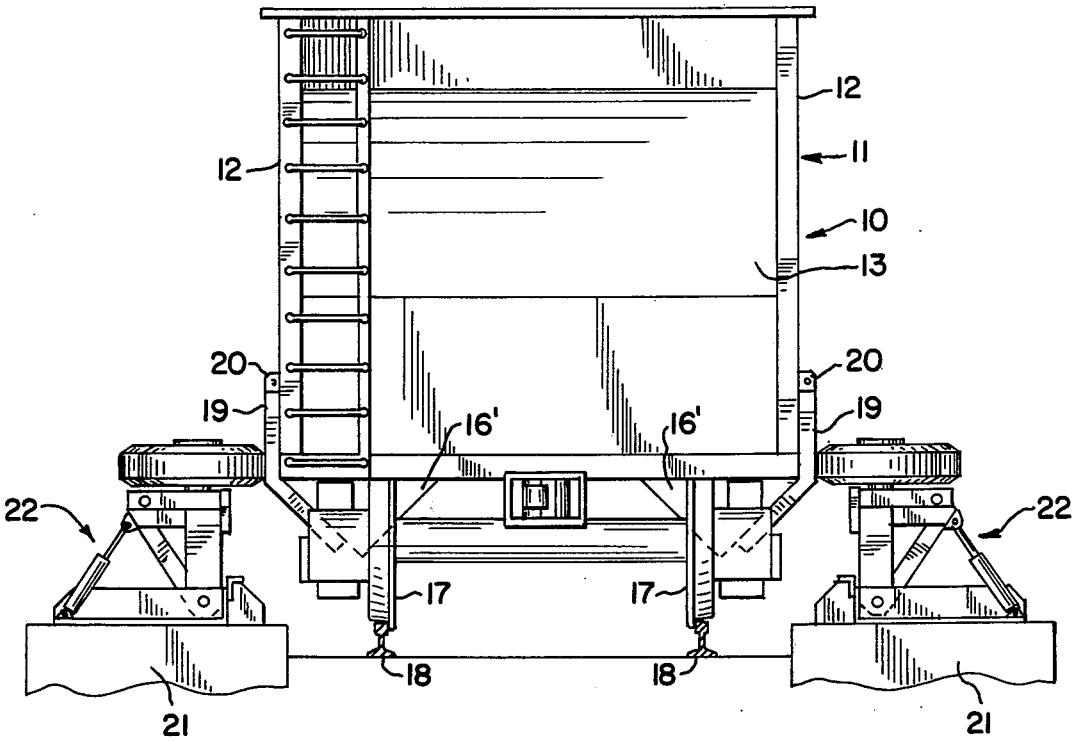
FIG. 6 is an end elevational view of a railway car disposed between a pair of trackside door closing arrangements and FIG. 7 is a view similar to FIG. 6 showing the position of a railway car and trackside door closing mechanisms when the car is in a tilted position.
Figure 7:
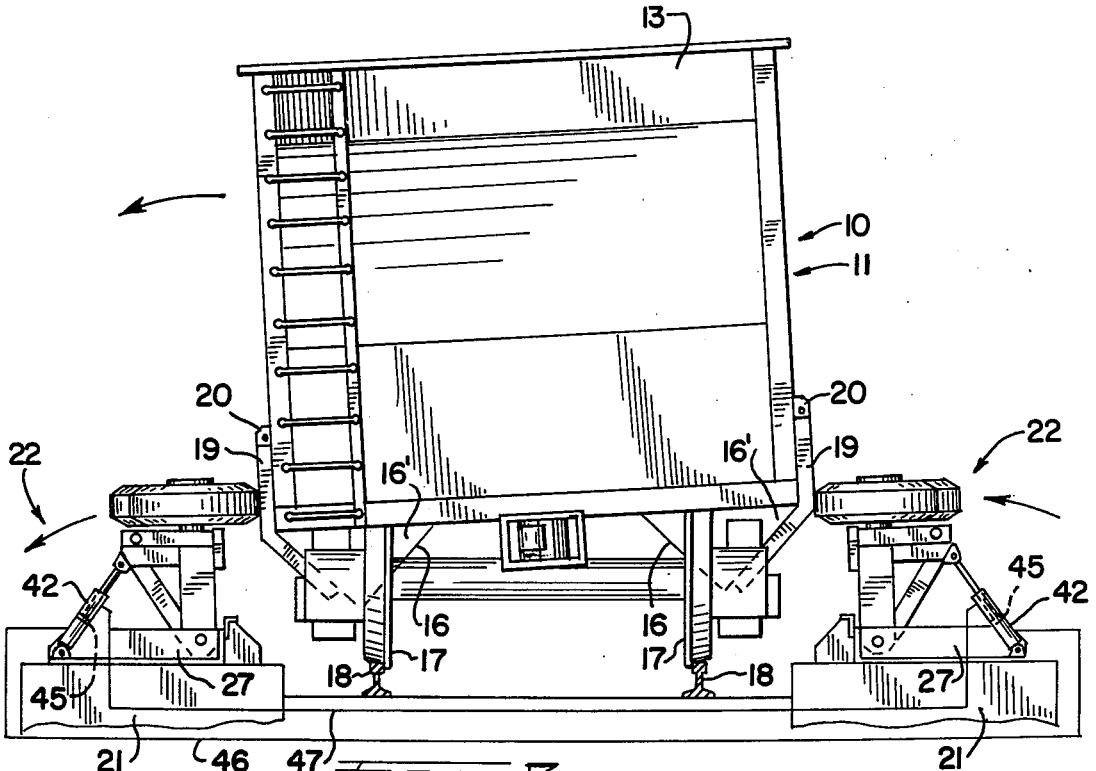

The lower portion of the hoppers are best shown in FIGS. 5, 6 and 7 and include lower outwardly extending slope sheets 16 having lower vertical hopper sides 16'. The hopper car is supported on conventional wheel trucks 17 and tracks 18 and include outwardly swinging side doors 19. The side doors 19 include diagonal door sections 24 connected to vertical door sections 25 which in turn are pivotally supported on the sides of the car by means of hinge members 20. Each of the doors closes a discharge opening generally designated at 23 and disclosed in FIG. 5. The specific door arrangement and a door closing mechanism for each door is specifically described in the aforementioned related patent application.

As best shown in FIG. 1 a pair of concrete slabs 21 are positioned alongside the right-of-way or adjacent to the tracks 18. Each of the concrete slabs 21 is adapted to support a trackside door operating mechanism or arrangement generally designated at 22. Each of the mechanisms 22 includes a base 27 having a base angle 28 fixedly secured to the concrete slabs. An upright pedestal 29 is secured to a second base angle 30 extending perpendicular with respect to the angle 28. The angle 28 is provided with vertical horizontally spaced plates 31 and 32 suitably apertured to carry a pin 34 which extends through the upright pedestal 29 for pivotally mounting the same to the base. The plate 33 supported on the base plate 30 also is suitable apertured and supports the pivot pin 34. A diagonal brace 35 suitably connected to the plate 33 projects upwardly and is suitably connected to the upper end of the upright pedestal 29. A horizontal channel 36 is connected to the upper end of the upright pedestal 29 and projects outwardly with respect thereto. A diagonal brace 37 suitably connected to the lower end of the upright pedestal 29 projects upwardly and is secured to the channel 36. Ears 38 are suitably connected to the upper ends of the diagonal 37 and a piston rod 39 includes an eye 40 which is connected to the ears by means of an attaching bolt 41. The piston rod 39 extends and reciprocates with respect to a fluid extensible device or cylinder 42 which at its lower end is connected to the angle 28 by means of a bracket 43 and pivotal connection 44. A piston 45 reciprocates within the cylinder 42 as indicated in FIG. 5. As best shown in FIG. 7 hydraulic conduits 47 are connected to the upper ends of each cylinder and hydraulic conduits 46 are connected to the lower ends of each cylinder.

Figure 4:
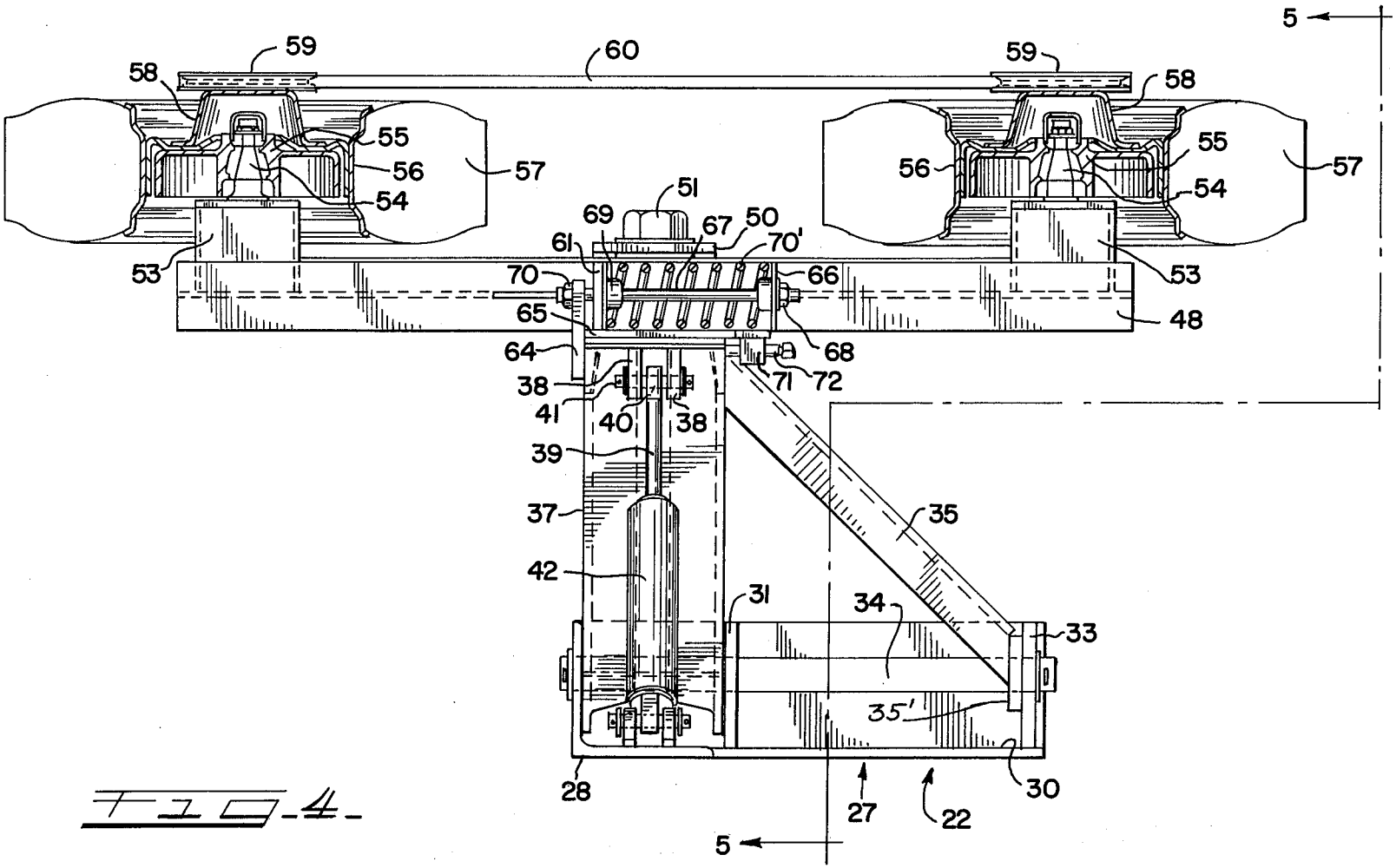
FIG. 4 is a cross-sectional view taken along the line 4—4 of FIG. 3.

An arm 48 is supported on the vertical pedestal 29 for horizontal pivotal movement about a vertical axis. The arm is constructed of an I-beam and includes a central web 49. As best shown in FIGS. 4 and 5 an L-shaped bracket 50 is rigidly connected to the sides of the vertical pedestal 29 and overlaps the same with respect to the upper surface of the arm 48. A bolt 51 extends through the bracket 50 the web 48 and flange 52 of the angle 36 for connection with a nut 51' to suitably support the arm 48 for horizontal movement about the vertical pivot axis provided. The ends of the arm 49 are provided with vertical wheel supports 53 from which project upwardly spindles or axles 54 of a type similarly used in automobile vehicles. Each of the spindles 54 rotatably supports a bearing and hub assembly 55 in turn supporting for rotation therewith tire rims 56 in turn carrying standard pneumatic automobile type tires 57. A hub extension 58 is connected to each of the tire rims 56 and supports thereon pulleys 59 which are interconnected by means of an endless belt 60 so that movement of one of the tires 57 is imparted to the other.

Figure 3:
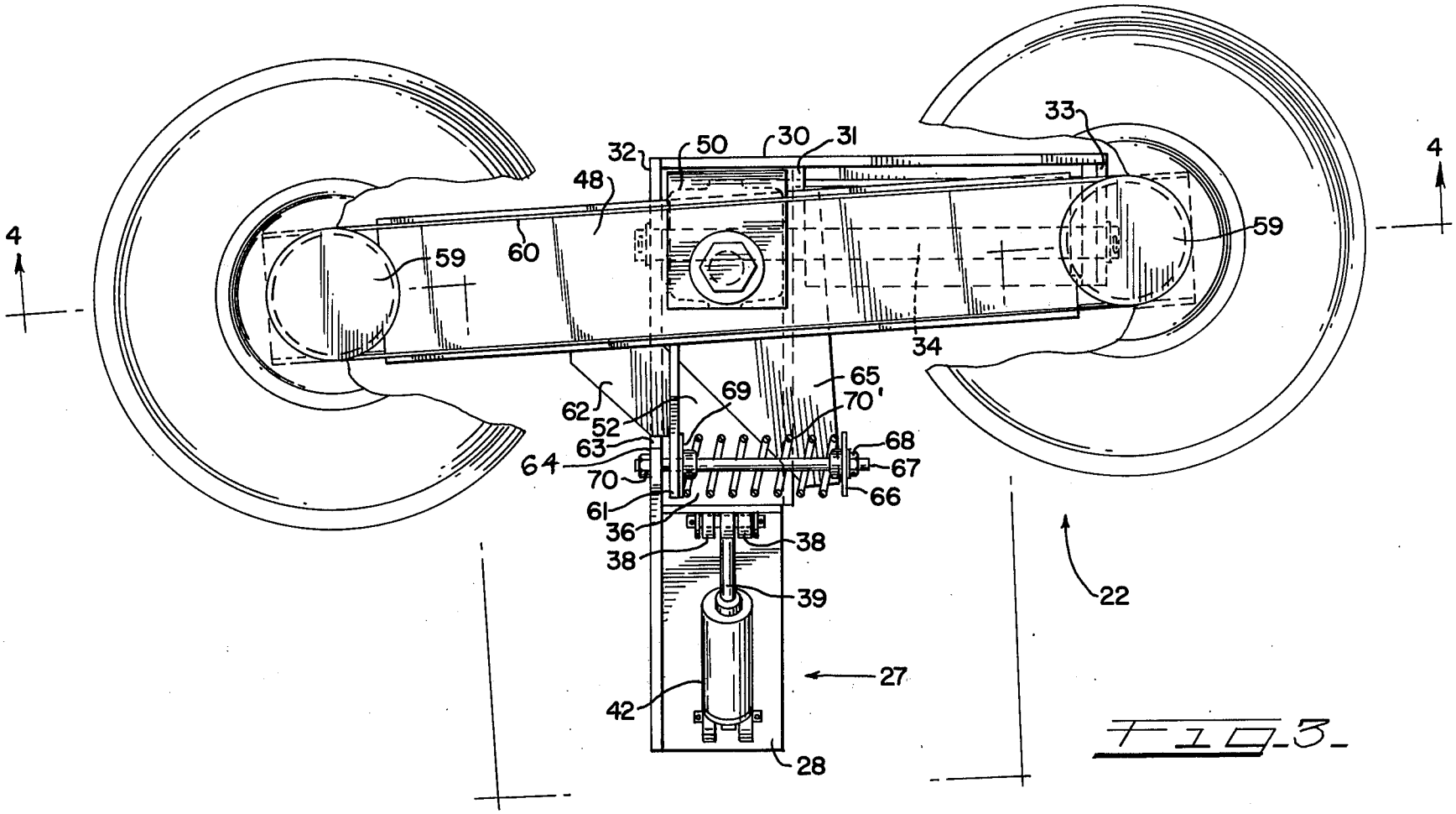
FIG. 3 is an enlarged plan view of a trackside door closing arrangment.

Referring now particularly to FIGS. 3 and 4 a vertical plate 61 is suitably connected to the arm 48 and is reinforced by means of a gusset 62. The gusset 62 is adapted to project through an opening 63 provided in a vertical plate 64 connected to the upper end of the pedestal 29. The arm 48 also supports an upper plate 65 which projects outwardly as best shown in FIG. 3. The plate 65 supports an adjustment block 71 having an ajustment bolt 72 connected thereto the adjustment bolt 72 being adapted to engage the flange 52 in order to provide for horizontal adjustment of the arm 48 relative to the fixed base assembly 27. Thus the diagonal position of the arm 48 as shown in FIG. 3 may be varied by means of the adjustment provided by the adjustment bolts 72 and block 71. A spring retainer 66 is supported on a rod 67 held thereon by means of a hexagonal screw 68 as best shown in FIGS. 3, 4 and 5. The rod 67 extends through another spring retainer 69 in engagement with the vertical plate 61. The rod 67 extends through the vertical plate 61 and through the vertical plate 64 being secured thereto by means of a nut 70 threaded onto the ends of the rods 67. A spring 70' is held captive between the plate 61 and spring retainer 66.

As best shown in FIG. 5 the amount of tilting movement of the vertical pedestals 29 can be limited by means of the adjusting bracket 73 which is connected to the base angle 30 and the adjusting screw 74.

OPERATION

Figure 2:
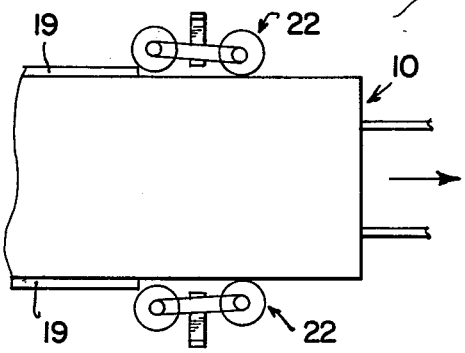
FIG. 2 is a schematic plan view of one end portion of a railway car showing the position of a pair of trackside door closing mechanisms.

The operation of the side swinging doors and locking mechanisms therefore are described in the above-related application. As the railway car moves to its dumping destination the doors are opened and the load is dumped by gravity whereupon the doors remain in a slightly ajar position and are now ready for closing movement. The closing movement is accomplished by the present side-of-track actuating mechanisms disposed on opposite sides of the car. The closing action is particularly well disclosed in FIGS. 1 and 2. In the schematic view of FIG. 2 the trackside door operating mechanisms are ready for closing the car doors after the railway car leaves its dumping position and passes between the trackside mechanisms disclosed. Speaking in the direction of movement the first wheels engage the open door sides 19 and rotating movement is imparted to the first wheels which starts closing movement of the doors as the car progresses through and between the trackside mechanisms. The second wheels are also rotated in concert with the first wheels by means of the endless belt arrangements disclosed. This rotating movement thus imparted to the second wheels also causes the doors to be swung inwardly as the second wheels engage the doors thereby accelerating movement of the doors inwardly to their locked position.

As best shown in FIG. 7 there are occasions when the cars are tilting due to normal car movement. If this occurs it is seen that the vertical pedestals are free to tilt inwardly and outwardly as desired and when one of the pedestals tilts in one direction the other on the other side of the car also tilts in that direction by virtue of the fluid extensible devices and conduit type of connection. Thus even though the car may be weaving or tilting back and forth as it enters through the door closing mechanisms the door closing mechanisms adjust for the tilting movement and continue to function in the intended manner. The angular position of the arm 48 and connected wheels may be adjusted simply by actuating the adjusting mechanism 71 and adjusting bolt 72. Also the tilting action may be limited by means of the adjustment 74. The spring arrangement of the spring 70' is effective to provide cushioning means and accommodate sudden variations of the arm relative to the vertical pedestal varying closing arrangements. The tension of the spring 70' can of course also be simply adjusted by manipulating the bolts 68 and 70 relative to the rod 67.

Thus it is seen that an effective door closing mechanism has been described which is an improvement over the prior art in structure and in function.

What is claimed is:

1. For a railway hopper car having a longitudinally extending discharge door hingedly mounted on the car for movement laterally outwardly from closed to open position relative to a discharge opening, the improvement comprising:

a trackside operating mechanism including a base positioned to one side of a railway track, an upright pedestal mounted on said base, a horizontal arm pivotally mounted on said base for swinging movement on a vertical axis, wheel means including a pair of wheels longitudinally spaced on said arm for pivotal movement about vertical axis, means connected to one wheel for imparting rotation of said one wheel to said other wheel, said wheel means being positioned to engage the side of an open door of said hopper car traveling along the side of said trackside operating mechanism thereby swinging said door inwardly toward said car to a closed position.

2. The invention in accordance with claim 1, said wheel means comprising a pair of wheels having flexible tires and being longitudinally spaced on said arm for pivotal movement about vertical axes.

3. The invention in accordance with claim 1, said upright pedestal including pivotal means connected to said base whereby said pedestal is tiltable laterally inwardly and outwardly relative to said railway car.

4. The invention in accordance with claim 3, including a second similar trackside operating mechanism on the opposite side of said railway track, fluid extensible devices pivotally connected to said bases and to said upright pedestals, and fluid conduits connected to opposite ends of said extensible devices whereby tilting pivotal movement of one pedestal in one direction in response to tilting of said railway car, results in tilting pivotal movement of said opposite pedestal in the same direction.

5. For a railway hopper car having a longitudinally extending discharge door hingedly mounted on the car for movement laterally outwardly from closed to open position relative to a discharge opening, the improvement comprising:

a trackside operating mechanism including a base positioned to one side of a railway track, an upright pedestal mounted on said base, a horizontal arm pivotally mounted on said base for swinging movment on a vertical axis, wheel means on said arm, said wheel means being positioned to engage the side of an open door of said hopper car traveling along the side of said trackside operating mechanism thereby swinging said door inwardly toward said car to a closed position, said wheel means comprising a pair of wheels having flexible tires and being longitudinally spaced on said arm for pivotal movement about vertical axes, and means connected to one wheel for imparting rotation of said one wheel to said other wheel.

6. The invention in accordance with claim 1, said means for imparting rotation comprising first and second pulleys connected to said wheels, and a belt trained about said pulleys.

7. The invention in accordance with claim 1, including adjustable means on said arm positioning one end of said arm and adjacent said first wheel laterally outwardly relative to said other end of said arm and adjacent said second wheel.

8. The invention in accordance with claim 7, said adjustable means including biasing means connected to said arm and to said upright pedestal.

9. The invention in accordance with claim 7, said adjustable means including an adjustable member rotatably mounted on said arm and being engageable with said upright pedestal.

* * * * *